US006298671B1

(12) United States Patent
Kennelley et al.

(10) Patent No.: US 6,298,671 B1
(45) Date of Patent: Oct. 9, 2001

(54) METHOD FOR PRODUCING, TRANSPORTING, OFFLOADING, STORING AND DISTRIBUTING NATURAL GAS TO A MARKETPLACE

(75) Inventors: Kevin Kennelley, UKay Heights (MY); Paul D. Patterson, McKinney, TX (US)

(73) Assignee: BP Amoco Corporation, Chicago, IL (US)

( * ) Notice: Subject to any disclaimer, the term of this patent is extended or adjusted under 35 U.S.C. 154(b) by 0 days.

(21) Appl. No.: 09/593,217

(22) Filed: Jun. 14, 2000

(51) Int. Cl.[7] ..... F17C 9/02
(52) U.S. Cl. ..... 62/50.2; 62/53.1
(58) Field of Search ..... 62/50.1, 50.2, 62/53.1

(56) References Cited

U.S. PATENT DOCUMENTS

| | | | | |
|---|---|---|---|---|
| 2,105,383 | * | 1/1938 | White | 62/53.1 |
| 2,864,242 | * | 12/1958 | Muller | 62/53.1 |
| 2,975,604 | * | 3/1961 | McMahon | 62/614 |
| 3,018,632 | * | 1/1962 | Keith | 62/614 |
| 3,400,545 | | 9/1968 | Hendal . | |
| 3,400,547 | | 9/1968 | Williams et al. . | |
| 3,407,606 | * | 10/1968 | Khan et al. | 62/50.2 |
| 3,524,897 | | 8/1970 | Kniel . | |
| 3,535,885 | * | 10/1970 | Frijlink et al. | 62/614 |
| 3,548,024 | | 12/1970 | Kniel . | |
| 3,675,436 | | 7/1972 | Ganiaris . | |
| 3,849,096 | | 11/1974 | Kniel . | |
| 4,054,433 | | 10/1977 | Buffiere et al. . | |
| 4,055,050 | | 10/1977 | Kozlov . | |
| 4,121,917 | | 10/1978 | Baker et al. . | |
| 6,012,292 | * | 1/2000 | Gulati et al. | 62/53.1 |

FOREIGN PATENT DOCUMENTS

| | | |
|---|---|---|
| 1560096 | 1/1980 | (GB) . |

* cited by examiner

*Primary Examiner*—Ronald Capossela
(74) *Attorney, Agent, or Firm*—James A. Gabala; F. Lindsey Scott; Robert E. Sloat

(57) ABSTRACT

A method for efficiently producing, transporting, offloading, storing and distributing a natural gas to a marketplace. The method comprising producing the natural gas from a first subterranean formation, liquefying the natural gas to produce a liquefied natural gas, transporting the liquefied natural gas to a re-gasification platform, offloading and pressurizing the liquefied natural gas, re-gasifying the liquefied natural gas to produce a re-gasified natural gas, and injecting the re-gasified natural gas into a second subterranean formation which is capable of storing natural gas and producing a product natural gas stream therefrom and transporting the product natural gas stream via a distribution system to a marketplace.

20 Claims, 1 Drawing Sheet

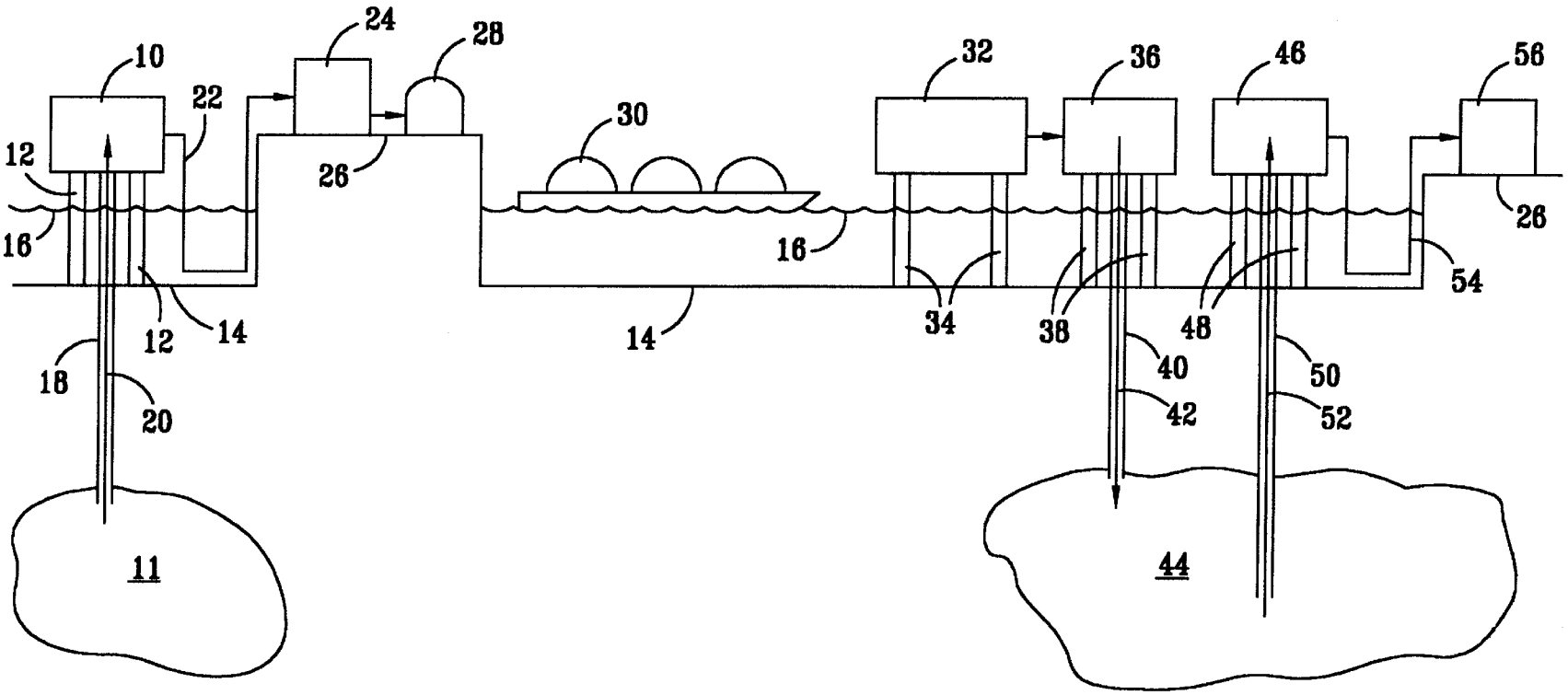
56
26
54
46
50
52
48
36
40
42
44
38
32
34
16
30
14
28
24
26
22
14
10
12
20
11
12
16
18

METHOD FOR PRODUCING, TRANSPORTING, OFFLOADING, STORING AND DISTRIBUTING NATURAL GAS TO A MARKETPLACE

BACKGROUND OF THE INVENTION

1. Field of the Invention

This invention relates to an efficient method for producing, transporting, offloading, pressurizing, storing and distributing to a marketplace a natural gas which is produced from a subterranean formation remotely located relative to the marketplace utilizing a subterranean formation capable of storing natural gas.

2. Brief Description of the Prior Art

Because of its clean burning qualities and convenience, natural gas has been widely used in recent years both for industrial use and for home heating. Many sources of natural gas are located in remote areas, which are not conveniently available to any commercial markets for the natural gas. When pipelines are unavailable for the transportation of the natural gas to a commercial market, the produced natural gas is often processed into liquefied natural gas (LNG) for transport to market. One of the distinguishing features of a LNG plant is the large capital investment required for the plant.

A further large investment is required at the destination for the LNG for cryogenic storage tanks near the marketplace to store the LNG until it is marketed. Such cryogenic facilities are relatively expensive and require re-gasification of the LNG for distribution via a pipeline system or the like to the ultimate consumers.

Where pipelines have been available to deliver natural gas to a marketplace, the demand for natural gas has fluctuated widely between low demand periods and peak demand periods. In such instances, natural gas has, in some instances, been stored in subterranean formations or cavities. The natural gas is delivered as a gas to the subterranean storage and subsequently retrieved from the subterranean storage for delivery to a pipeline or other system to distribute it to the ultimate consumers. These systems require that natural gas be available as a gas from pipelines for storage in the subterranean storage areas.

Natural gas is typically available at pressures from about 250 psig (pounds per square inch gauge) to about 10,000 psig at temperatures from 80 to about 350° F. from many subterranean gas-bearing formations. This gas is readily processed by well-known technology into liquefied natural gas. Various refrigeration cycles have been used to liquefy natural gas with the three most common being the cascade cycle which uses multiple single component refrigerants and heat exchangers arranged progressively to reduce the temperature of the gas to liquefaction temperature, the expander cycle which expands gas from a high pressure to a low pressure with a corresponding reduction in temperature, and multi-component refrigeration cycles which use a multi-component refrigerant and specially designed heat exchangers to liquefy the natural gas. Combinations of these processes have also been used. LNG is typically transported by sea in cryogenic tanker ships.

As noted previously, both of these methods entail certain disadvantages, i.e. the transportation of natural gas by pipeline is limited by the availability of the pipeline system; therefore, the storage of natural gas in gaseous form in subterranean formations, cavities or surface storage facilities is limited to those areas in which greater quantities of natural gas can be delivered, then can be used during low demand periods. Similarly, the use of liquefied natural gas, which is liquefied at or near the marketplace, is also limited to those areas where an excessive amount of natural gas can be delivered during at least a portion of the year. As indicated previously, this practice also requires the construction and use of cryogenic tanks, which are relatively expensive.

The use of liquefied natural gas which has been liquefied at a production site at a remote location also requires the use of cryogenic storage space and re-gasification equipment at or near the marketplace so that the LNG can be stored until it is desired to re-gasify the LNG and use it.

As noted above, various systems for producing liquefied natural gas from natural gas are well known. Some such systems are shown, for instance, in U.S. Pat. No. 4,033,735, issued Jul. 5, 1977 to Leonard K. Swenson, and U.S. Pat. No. 5,657,643, issued Aug. 19, 1997 to Brian C. Price, and U.S. Pat. No. 3,855,810, issued Dec. 24, 1974 to Simon et al.

Re-gasification systems for re-gasifying liquefied natural gas are also known. These systems can vary widely but include systems such as open rack vaporizers which are typically used with seawater as a heat exchange medium, shell and tube vaporizers which use either seawater, glycol-freshwater mixtures, or propane and an intermediate as the heat exchange medium. Submerged combustion vaporizers, steam-heated vaporizers and ambient air heated vaporizers are other means for re-gasifying liquefied natural gas. A wide variety of vaporizers can be used so long as they are effective to re-gasify the LNG by heat exchange with some suitable heat exchange medium.

Accordingly, in view of the expense of delivering the natural gas to consumers by either of the foregoing methods, continued efforts have been directed to the development of more efficient methods for delivering natural gas from a remote production site to a marketplace more efficiently.

SUMMARY OF THE INVENTION

According to the present invention, a method is provided for efficiently producing, transporting, storing and distributing to a marketplace a natural gas, the method comprises producing the natural gas from a first subterranean formation, liquefying the natural gas to produce a liquefied natural gas, transporting the liquefied natural gas to a re-gasification facility (onshore, offshore or a combination of both), offloading and re-gasifying the liquefied natural gas to produce a re-gasified natural gas at a suitable pressure for injection, and injecting the re-gasified natural gas into a second subterranean formation which is capable of storing natural gas. Production wells and associated facilities with a pipeline to the marketplace are utilized to deliver the stored natural gas to the marketplace from the second subterranean formation.

BRIEF DESCRIPTION OF THE DRAWINGS

The FIGURE is a schematic diagram of an embodiment of the present invention.

DESCRIPTION OF THE PREFERRED EMBODIMENTS

According to the present invention, a natural gas is efficiently delivered to a marketplace by liquefying the natural gas at or near the production site, transporting the liquefied natural gas to a re-gasification facility, offloading and pressurizing the liquefied natural gas to re-injection pressures, regasifying at pressure and injecting the natural gas into a subterranean formation suitable for storing natural gas as a product for delivery to a marketplace accessible by a distribution system from the second subterranean formation. The re-injection pressure of the gas can be achieved as described above by pressurizing the liquefied natural gas prior to the re-gasification, or by conventional compression equipment for the natural gas after re-gasification, or a combination of both. The re-injection rate of the re-gasified natural gas is equal to the offloading rate of liquefied natural gas thereby eliminating the need for cryogenic liquefied natural gas storage tank facilities at the re-gasification platform. The natural gas is then contained in the second subterranean formation until it is desired to produce the gas for distribution. Production wells and associated facilities with pipeline to the marketplace are utilized to deliver the stored natural gas to the marketplace from the second subterranean formation. The gas may be produced by the same production system previously used to natural gas from the second formation and may be distributed via the same distribution system previously used for the distribution of natural gas from the second subterranean formation.

While natural gas could be delivered as LNG, re-gasified and distributed directly to the pipeline, such requires the construction of expensive cryogenic facilities to store the LNG prior to re-gasification at a relatively continuous rate for a steady supply to the pipeline. Utilizing the second subterranean formation to store the natural gas thereby eliminating the need for cryogenic storage and allowing for variable natural gas production rates to meet market needs. This results in a more economical and flexible system for storing and distributing the LNG than the relatively expensive cryogenic facilities previously used.

As shown in FIG. 1 schematically, an embodiment of the present invention comprises an offshore platform 10 including producing wells and production facilities positioned to produce natural gas from a first remotely located subterranean formation 11, which is a natural gas-producing field. The platform is supported by supports 12 from a sea floor 14 above a sea level 16. The production is achieved via a well 18 as shown by arrow 20. The produced gas is passed via a pipeline 22, which is shown as a pipeline extending from offshore platform 10 to an LNG plant shown schematically at 24. Producing wells and production facilities for the LNG plant may be located offshore as shown or located onshore depending upon the location of the producing subterranean formation 11. LNG plant 24 as shown is positioned on land 26. LNG plant 24 may be positioned on either a platform, floating or grounded vessel, or land, as convenient. In LNG plant 24 the natural gas is liquefied and passed to LNG storage 28. From LNG storage 28, a ship 30, which is shown schematically as an LNG tanker, is loaded and transports the natural gas to a docking and re-gasification platform 32. Platform 32 is supported from sea floor 14 by supports 34. Platform 32 is constructed to be sufficiently sturdy to permit docking and unloading operations from LNG tanker 30. From platform 32 the LNG is pressurized using cryogenic booster pumps and then re-gasified as known to those skilled in the art. The LNG may be re-gasified by the use of any suitable heat exchange system such as an open rack vaporizers, a shell and tube vaporizers using either seawater, glycol-freshwater mixtures or propane as an intermediate or any other suitable heat exchange medium, submerged combustion vaporizers, steam heated vaporizers, or ambient air heated vaporizers and the like. Combinations of these types of vaporizers may be used. Desirably, seawater is used as a heat exchange medium on platform 32. While the natural gas may be re-gasified by any suitable heat exchange method, according to the present invention it is preferred that an open rack vaporizer be used, using seawater as the heat exchange medium. The re-injection pressure of the gas can be achieved as described above by pressurizing the liquefied natural gas prior to re-gasification or by conventional compression equipment of the natural gas after re-gasification or by using both techniques. The natural gas is then passed to an injection platform 36 supported by supports 38 above sea floor 14 where it is injected via a well 40 into a second subterranean formation 44, as shown by arrow 42. Second subterranean formation 44 is capable of storing natural gas and may be a depleted or at least partially depleted subterranean formation which has previously produced gas in sufficient quantities to justify the construction of a system of producing wells, gathering facilities and distribution pipelines for the distribution to a market of natural gas from subterranean formation 44. After and during the injection of the re-gasified liquefied natural gas, production may be achieved from second formation 44 via a well 50, as shown by arrow 52, to a platform 46 which is supported on supports 48 above sea floor 14. Platforms 36 and 46 may be located either on shore as facilities or off shore on platforms. It is, however, desirable that platform 32 be located off shore or near shore to allow for LNG tanker access and offlading and for convenience in the use of seawater as the heat exchange medium.

The produced gas from second formation 44 via platform 46 is passed via a pipeline 54 to a pipeline system 56. It will be understood that platform 46 schematically depicts a plurality of platforms positioned to recover natural gas from subterranean formation 44. Either plurality of platforms or platforms using a plurality of directionally drilled wells or both and the like may be used and the like, as known to those skilled in the art for production of natural gas from a subterranean formation comprising a natural gas field. Similarly, a plurality of gathering lines may be used as shown schematically by pipeline 54. The natural gas, as collected, is then delivered to a pipeline system 56, which is not shown in any detail. It is well understood by those skilled in the art that it may be necessary, and in fact typically is necessary, to treat the recovered natural gas for the removal of hydrogen sulfide and carbon dioxide compounds, water and possibly other contaminants prior to delivering it to a commercial pipeline system.

According to the present invention, the natural gas has been liquefied and can be transported via ship or otherwise over substantial distances from remote gas fields to a re-gasification facility where it is offloaded, pressurized, re-gasified and stored, without the need for cryogenic storage facilities, in a second subterranean formation capable of storing natural gas from which it can be produced through production wells and gathering facilities and a pipeline distribution.

In summary, the present invention represents a remarkably efficient system for producing, transporting, storing and distributing natural gas to a marketplace. The savings are achieved by the use of an existing storage capacity in second formation 44, the use of re-gasification as the LNG is unloaded from tanker 30 to avoid the need for cryogenic storage at platform 32. These advantages result in substantial savings by comparison of the method of the present invention to existing processes for the production and delivery of natural gas from remotely located natural gas fields. The present method also permits the use of sufficient re-gasification capacity to facilitate rapid unloading of a LNG vessel so that the vessel is detained for unloading for a minimal period.

Typically, the natural gas is re-gasified at platform 32 to have an injection temperature slightly above the gas hydrate temperature within the second subterranean formation 44 as injected via well 40 from about 50° F. to about 85° F. The natural gas is injected into the second subterranean reservoir at pressures of between 200 psi and 2500 psi or higher depending upon the depleted reservoir pressure requirement. The conditions for the delivery of natural gas to pipeline 56 are, of course, set by the individual pipeline requirements with respect to pressure, temperature and gas contaminants.

Having thus described the present invention by reference to certain of its preferred embodiments, it is noted that the embodiments disclosed are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, we claim:

1. A method for efficiently producing, transporting, storing and distributing to a marketplace a natural gas, the method comprising:

a) producing the natural gas from a first subterranean formation;

b) liquefying the natural gas to produce a liquefied natural gas;

c) transporting the liquefied natural gas to a re-gasification platform;

d) re-gasifying the liquefied natural gas to produce a re-gasified natural gas; and e) injecting the re-gasified natural gas into a second subterranean formation which is capable of storing natural gas and producing a product natural gas stream therefrom and transporting the product natural gas stream via a distribution system to a marketplace.

2. The method of claim 1 wherein the natural gas is treated for the removal of hydrogen sulfide, carbon dioxide, water and other contaminants prior to liquefaction.

3. The method of claim 1 wherein the liquefied natural gas is transported via a ship.

4. The method of claim 1 wherein the re-injection pressure of the natural gas is accomplished by pressurizing the liquefied natural gas prior to re-gasification, or by conventional compression equipment of the natural gas after re-gasification, or a combination of both.

5. The method of claim 1 wherein the liquefied natural gas is re-gasified by heat exchange with seawater.

6. The method of claim 1 wherein the liquefied natural gas is re-gasified using a heat exchange system selected from the group consisting of an open-rack vaporizer, a shell and tube vaporizer using either seawater or glycol-freshwater mixtures, or with propane as an intermediate, a submerged combustion vaporizer, a steam heated vaporizer and an ambient air heated vaporizer.

7. The method of claim 1 wherein the liquefied natural gas is re-gasified using an open-rack vaporizer for heat exchange with seawater.

8. The method of claim 1 wherein the re-gasified natural gas is injected into the second subterranean formation above the hydrate temperature of the gas contained in the subterranean reservoir at temperatures from 32° F. to about 80° F.

9. The method of claim 1 wherein the re-gasified natural gas is injected into the second subterranean formation at a pressure greater than the pressure in the second subterranean formation.

10. The method of claim 9 wherein the pressure is from about 200 to about 2500 psig.

11. The method of claim 1 wherein the distribution system is adapted to deliver produced natural gas from the second subterranean formation capable of storing natural gas to a marketplace for the natural gas.

12. The method of claim 1 wherein wells and production facilities for producing the natural gas from the first subterranean formation is accomplished using onshore wells and production facilities and/or offshore wells and production facilities.

13. The method of claim 1 where the re-gasification facilities, re-injection wells and facilities of the natural gas into the second subterranean formation, and wells and production facilities from the second subterranean formation are located offshore, onshore, or a combination of both.

14. The method of claim 1 whereby transfer of the liquefied natural gas to onshore facilities is to be accomplished using a conventional offoading/docking/berthing facility with associated jetty and cryogenic pipeline.

15. A method for efficiently producing, transporting, offloading, storing and distributing to a marketplace a natural gas, the method comprising:

a) producing the natural gas from a first subterranean formation;

b) liquefying the natural gas to produce a liquefied natural gas;

c) transporting the liquefied natural gas to a re-gasification facility;

d) offloading and pressurizing the liquefied natural gas;

e) re-gasifying the liquefied natural gas to produce a re-gasified natural gas at boosted pressure; and f) injecting the re-gasified natural gas into a second subterranean formation which is capable of storing natural gas and producing a product natural gas stream therefrom and transporting the product natural gas stream via a distribution system to a marketplace.

16. A method for efficiently distributing to a marketplace a liquefied natural gas, the method comprising:

a) re-gasifying the liquefied natural gas to produce a re-gasified natural gas; and, b) injecting the re-gasified natural gas into a subterranean formation which is capable of storing the re-gasified natural gas and producing a product natural gas stream therefrom and transporting the produced natural gas stream via a distribution system to a marketplace.

17. The method of claim 16 wherein the re-injection pressure of the natural gas is accomplished by pressurizing the liquefied natural gas prior to the re-gasification by conventional compression equipment after re-gasification, or a combination of both.

18. The method of claim 16 wherein the liquefied natural gas is re-gasified by heat exchange with seawater.

19. The method of claim 16 wherein the liquefied natural gas is re-gasified using a heat exchange system selected from the group consisting of an open-rack vaporizer, a shell and tube vaporizer using either seawater or glycol-freshwater mixtures, or with propane as an intermediate, a submerged combustion vaporizer, a steam heated vaporizer and an ambient air heated vaporizer.

20. The method of claim 16 wherein the distribution system is adapted to deliver produced natural gas from the subterranean formation capable of storing natural gas to a marketplace for the natural gas.

* * * * *

UNITED STATES PATENT AND TRADEMARK OFFICE

CERTIFICATE OF CORRECTION

PATENT NO. : 6,298,671 B1
DATED : October 9, 2001
INVENTOR(S) : Kevin Kennelley, Paul D. Patterson It is certified that error appears in the above-identified patent and that said Letters Patent is hereby corrected as shown below:

Column 2,
Line 42, "natural gas, the method comprises" should read -- natural gas. The method comprises --

Column 3,
Line 57, "platform 32 the LNG is" should read -- platform 32, the LNG is --
Lines 60 and 61, "as an open rack vaporizers, a shell and tube vaporizers using" should read -- as open rack vaporisers, shell and tube vaporizers using --

Column 4,
Line 24, "access and offlading and" should read -- access and offloading and --
Line 31, "Either plurality of platforms or" should read -- Either a plurality of platforms or --
Lines 65 and 66, "of a LNG vessel so that" should read -- of an LNG vessel so that --

Signed and Sealed this

Nineteenth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,298,671 B1
DATED : October 9, 2001
INVENTOR(S) : Kevin Kennelley et al.

It is certified that error appears in the above-identified patent and that said Letters Patent is hereby corrected as shown below:

Column 3,
Line 19, after "to" insert -- produce --.
Line 29, delete "eliminating" and insert -- eliminates --.

Signed and Sealed this

Thirtieth Day of July, 2002

*Attest:*

*Attesting Officer*

JAMES E. ROGAN
*Director of the United States Patent and Trademark Office*